US005499001A

United States Patent [19]

Degun et al.

[11] Patent Number: 5,499,001

[45] Date of Patent: Mar. 12, 1996

[54] CAVITY MATCHED HYBRID COUPLER

[76] Inventors: Joginder S. Degun, 15903 Prairie Ave., #15, Lawndale, Calif. 90260; Robert Ahulii, 1023 Teri Ave., Torrance, Calif. 90503

[21] Appl. No.: 209,749

[22] Filed: Feb. 24, 1994

[51] Int. Cl.[6] ..... H01P 5/18

[52] U.S. Cl. ..... 333/115; 333/116

[58] Field of Search ..... 333/115, 116

[56] References Cited

U.S. PATENT DOCUMENTS

| | | | |
|---|---|---|---|
| 4,139,827 | 2/1979 | Russell . | |
| 4,459,568 | 7/1984 | Landt | 333/116 |
| 4,543,548 | 9/1985 | Seal et al. . | |
| 4,797,643 | 1/1989 | Wong et al. | 333/115 |
| 5,075,646 | 12/1991 | Morse | 333/116 |

FOREIGN PATENT DOCUMENTS

| | | |
|---|---|---|
| 0313059 | 4/1989 | European Pat. Off. . |
| 2665579 | 2/1992 | France . |
| 749337 | 5/1956 | United Kingdom . |
| 896707 | 5/1962 | United Kingdom . |
| 1168811 | 10/1969 | United Kingdom . |

*Primary Examiner*—Paul Gensler

*Attorney, Agent, or Firm*—Phyllis Y. Price; Wanda K. Denson-Low

[57] ABSTRACT

A microwave coupler is disclosed which includes an aluminum housing forming a cavity with upper and lower ground planes. A pair of substantially square-shaped conductors are supported within the cavity and symmetrically located with respect to the upper and lower ground planes. Each conductor has overlapping central portions and second and third portions extending in opposite directions at a 90 degree angle from the central portion to form a substantially H shaped configuration. A fourth portion extends at a 90 degree angle from the third portion of each conductor. The central portions of each conductor are ¼ wavelength and extend in parallel planes, separated by an air dielectric. The terminating portions of each conductor are provided with contacts providing input/output ports (A,B,C,D). The contacts are maintained in position by supports attached to the walls of the cavity at the central portions as well at the terminating portions. To compensate for the inductance introduced by the conductor bends, the cavity is machined in the vicinity of the 90 degree bends to create an increase in capacitance to compensate for the inductance and thereby achieve a substantially 3 db split between the input and output ports. A 4-way, 6 db coupler is also disclosed.

15 Claims, 4 Drawing Sheets

CAVITY MATCHED HYBRID COUPLER

TECHNICAL FIELD

This invention relates to microwave coupling devices and more particularly to a very low loss cavity tuned microwave coupler of relatively small size and light weight which is therefore especially useful in space applications.

BACKGROUND ART

Microwave power divider/combiners achieve higher microwave power levels by dividing microwave input power among plural amplifier circuits whose outputs are then combined to yield a greater balanced total output power. The splitting and combining may be accomplished by a coupler. A 3 dB hybrid coupler (2-way) has four ports and can be used, for example, to combine or sum the power at the two input ports to provide twice the power at a third or output port. The fourth port produces an output that is the difference between the two input ports and is terminated in a 50 ohm line. A 6 dB hybrid coupler (4-way) has eight ports and can be used, for example, to combine or sum the power at the four input ports to provide four times the power at a fifth or output port. The remaining three ports are terminated in 50 ohm lines. Similarly, when used as a splitter a 2-way coupler couples one-half of the power transmitted by an input transmission line to each of a pair of output transmission lines, and 4-way splitter couples one-fourth of the power at an input port to each of four output ports.

A stripline coupler generally has two quarter wave length conductors or strips running parallel in an enclosed square shaped cavity with the conductors terminating in right angle bends. One of the problems with such couplers is that discontinuities are introduced by the right angle bends. These bends cause a mismatch in the even-mode and odd-mode impedances resulting in an imbalance between the input and output ports of the coupler. In the prior art, these discontinuities were compensated by means of capacitive tuning screws or by placing tuning stubs-on the conductors. A typical design with such compensation is discussed in Microwave Filters, Impedance-Matching Networks, and Coupling Structures; G. Matthaei, L. Young, E. M. T. Jones; Artech House, Inc., 1964; pp. 793–797. This prior art approach requires precise positioning and dimensional tolerances, making the parts expensive because of the required mechanical accuracy and the machining difficulties.

SUMMARY OF THE INVENTION

In accordance with the present invention a microwave coupler is provided which includes an aluminum housing forming an intricate cavity with upper and lower ground planes. A pair of substantially square-shaped conductors are supported within the cavity, each conductor having first and second portions extending in opposite directions at a 90 degree angle from a central portion and a third extending at a substantially 90 degree angle from the second portion. The central portions of each conductor are ¼ wavelength and extend in parallel planes, separated by an air dielectric. The two conductors together define an overall generally H shaped configuration. The first and third portions of each conductor form end portions which are provided with precision contacts for connection with input/output ports. While the 90 degree bend contribute advantageously to the size and thus the weight of the coupler the discontinuities create an imbalance between the two output ports of the coupler. To compensate for these discontinuities and achieve a high degree of balance, the cavity is appropriately machined in the vicinity of the 90 degree bends to provide integral tuning elements which achieve the desired tuning. Since the cavity tuning elements are formed integrally with the cavity, a relatively simple and economical machining operation can be used to achieve the desired balance. By avoiding the prior art conductor tuning, the conductors may be symmetrically located with respect to the upper and lower ground planes of the coupler. Furthermore, the integral cavity tuning is not as sensitive in adjusting for balance as is the prior art tuning stub, since the stub introduces capacitance as well as reducing the impedance of the conductor while integral cavity tuning only changes the capacitance between the conductors and the cavity wall. It will be appreciated therefore that the present invention provides a relatively small, low loss or balanced coupler which achieves tuning by appropriate machining of the coupler cavity.

BRIEF DESCRIPTION OF THE DRAWINGS

A more thorough understanding of the present invention may be had from the following detailed description that should be read with the drawings in which.

DETAILED DESCRIPTION OF PREFERRED EMBODIMENT

Figure 1:
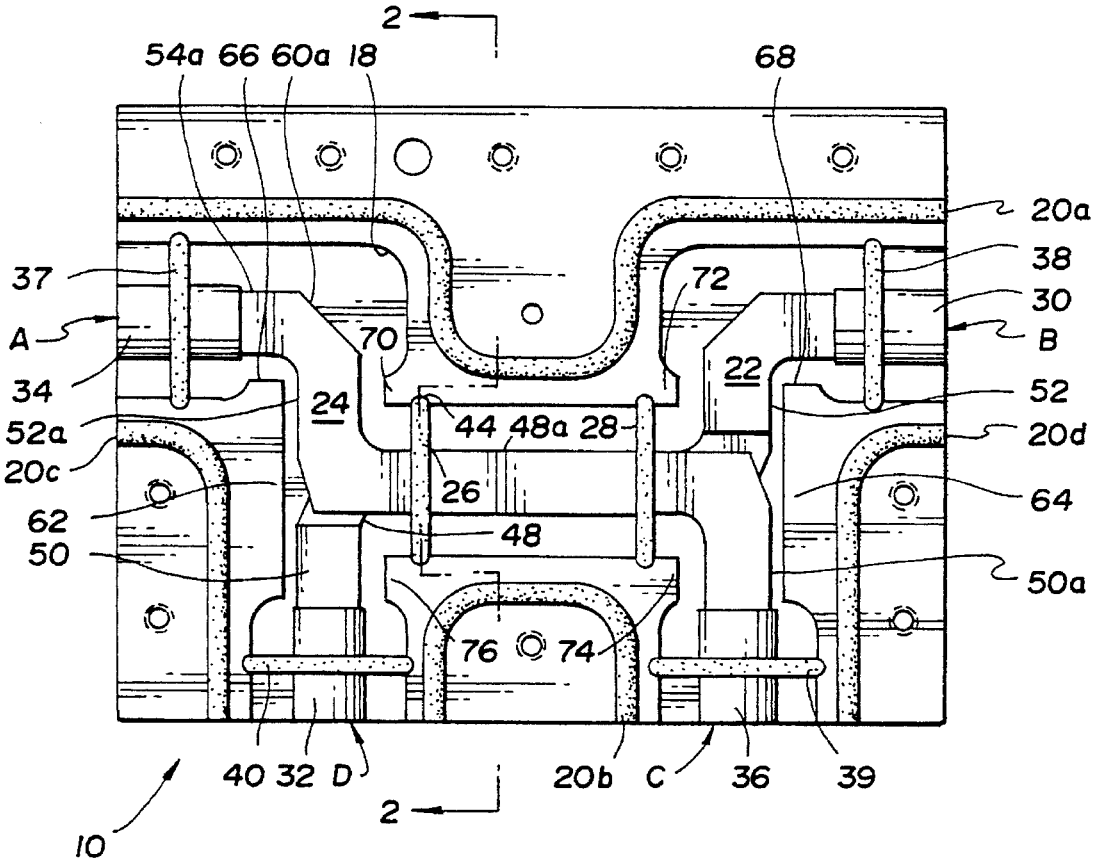
FIG. 1 is a top view of the coupler of the present invention with the top portion of the coupler housing removed.
Figure 2:
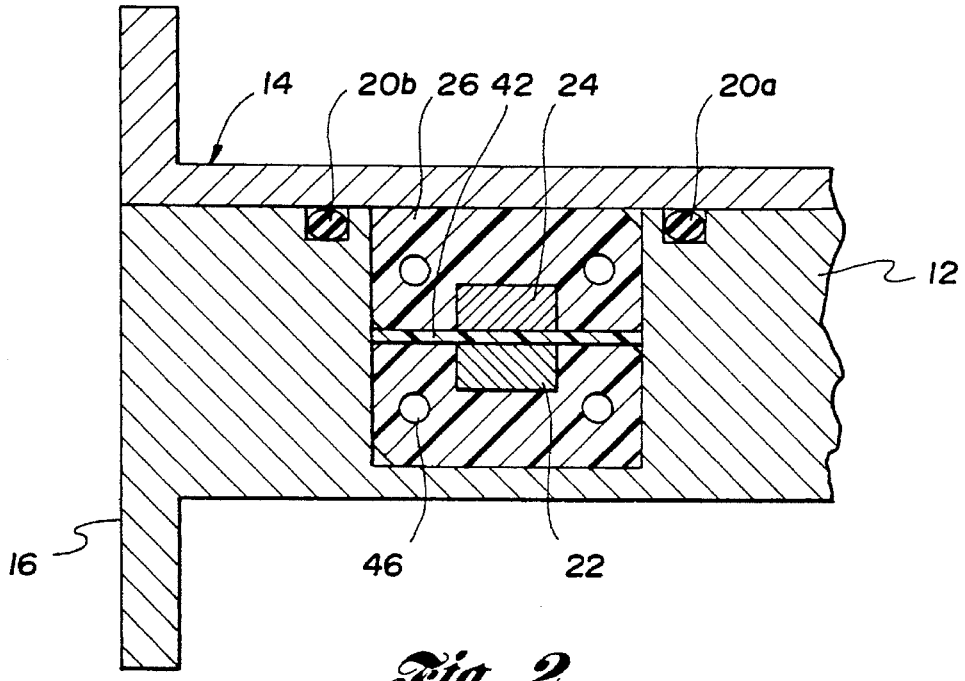
FIG. 2 is a cross sectional view taken along lines 2—2 of FIG. 1.

Referring now to the drawings and initially to FIGS. 1 and 2, the coupler of the present invention is generally designated 10 and comprises a housing 12 having a cover or top element 14 and a bottom element 16 forming a substantially square shaped cavity 18. The housing is machined from a block of aluminum and is grounded so that the top 14 and bottom 16 provide upper and lower ground planes respectively. A plurality of gaskets 20*a*–20*d* are provided to minimize radiation leakage from the cavity.

A pair of conductors 22 and 24 are supported within the cavity 18 by dielectric supports 26 and 28. The conductor 22 is connected with contacts 30 and 32 and the conductor 24 is connected with contacts 34 and 36. The precision contacts 30–36 permit electrical connection with devices external to the coupler at the ports A,B,C and D. The contacts and consequently the conductors are further supported by contact supports 37–40. A plastic spacer 42 (FIG. 2), formed of a low loss dielectric, is provided between the conductors 22 and 24 in the area of the support 26. A similar spacer, not shown, is provided between the conductors 22 and 24 in the area of the support 28. Otherwise the conductors 22 and 24 are separated by air. The spacers 42 maintain the correct distance between the center portions of the conductors 22 and 24. The supports 26 and 28, as well as the other supports 37–40, are inserted into generally "C" shaped slots, one of which is designated 44, created in the walls of the cavity 18. When the cover 14 of the coupler is attached the spacers undergo a slight compression and maintain the contacts 22 and 24 in position during temperature cycling and vibration of the coupler. Each of the dielectric supports 26 and 28 are provided with four holes, one of which is designated 46, for outgassing to equalize the pressure within the various chambers of the cavity defined by the dielectric supports and thus permit equal pressure within the cavity. The openings 46 also minimize the adverse tuning effects resulting from the dielectric supports 26, 28 by reducing the capacitance introduced by the supports.

Figure 3:
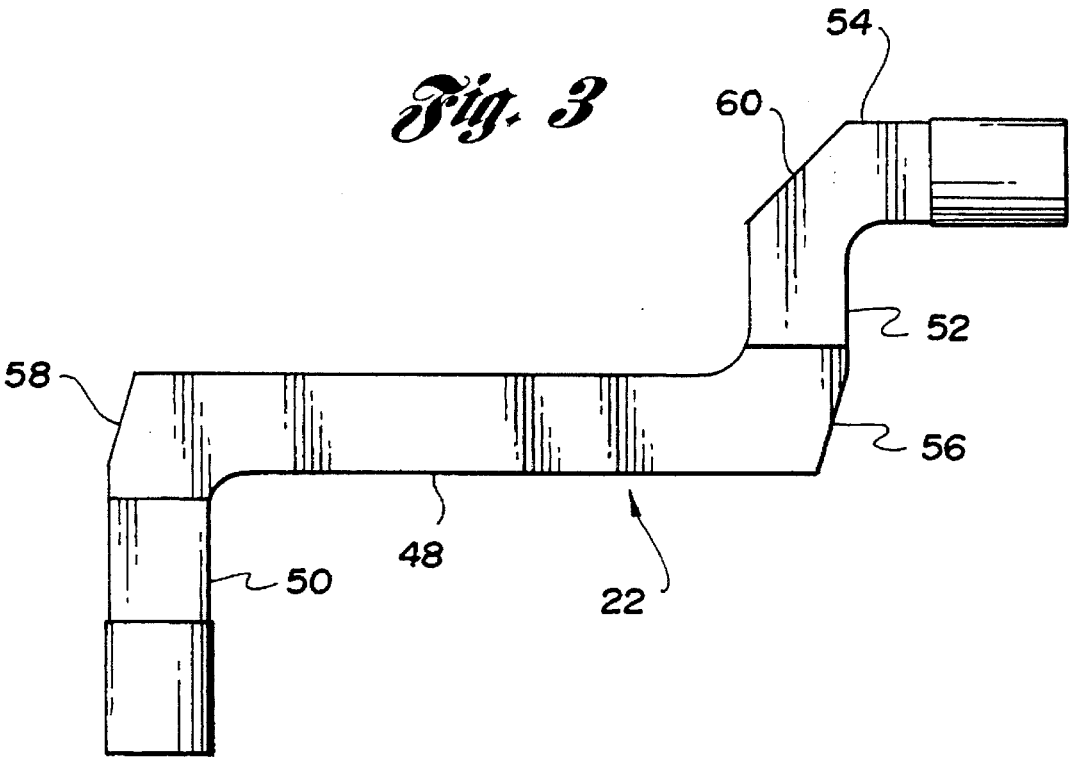
FIGS. 3 and 4 are top and front views of one of the conductors shown in FIG. 1.
Figure 4:
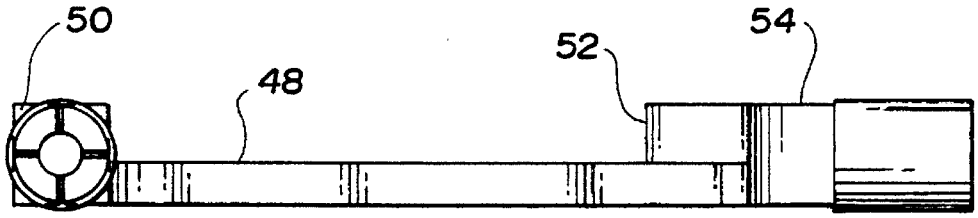
Figure 7:
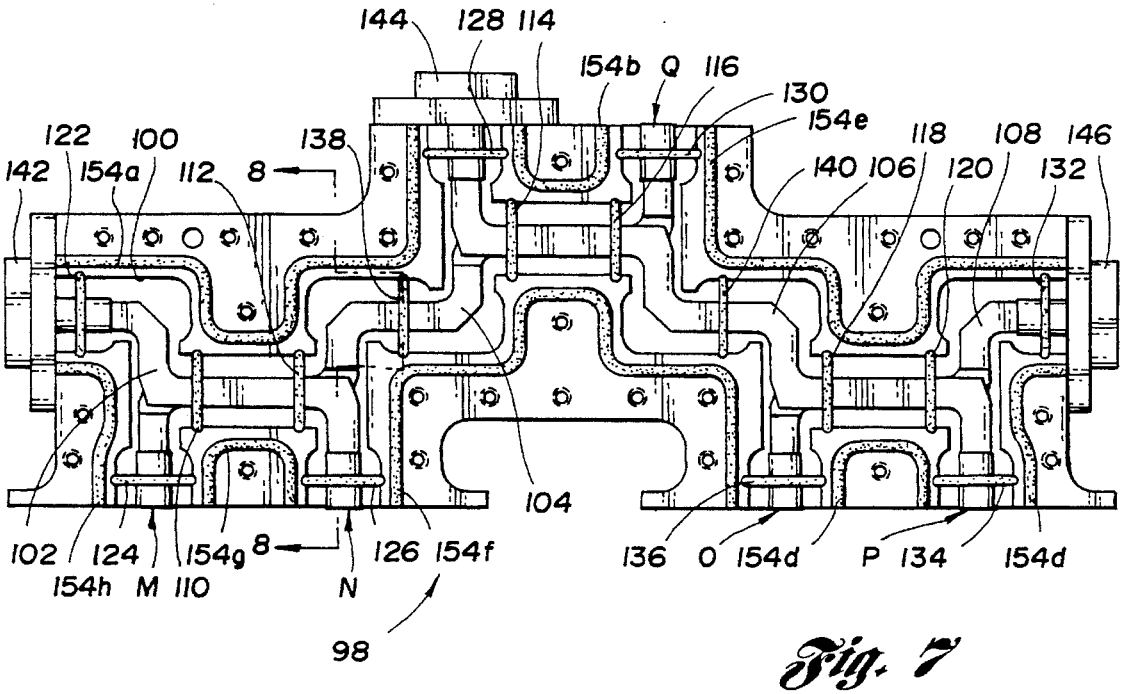
FIG. 7 is a top view of a third embodiment of the invention which is a 6 dB hybrid coupler with the top portion of the coupler housing removed.

As shown in FIGS. 3 and 4, the conductor 22, which is the mirror image of the conductor 24, has a central portion 48 of reduced thickness to accommodate the reduced thickness of the overlapping central portion of the conductor 24. Extending at a right angle from the central portion 48 are portions 50 and 52 of the conductor 22. Extending at a right angle from the portion 52 and therefore parallel to the central portion 48 is a portion 54. In the areas of the 90 degree bends where the portions 50 and 52 join the central portion 48, the conductor 22 is chamfered at a 15 degree angle, as indicated at 56 and 58. This is done to reduce the overall length of the overlapping portions 50 and 52 to fine tune the center frequency of the coupler. In the area of the 90 degree bend where the portion 54 joins the portion 52, the conductor 22 is chamfered at a 45 degree angle as indicated at 60. This is done to maintain a physically small size when the coupler is combined with two additional devices to form a 4-way (6 dB) splitter/combiner, which is shown in FIG. 7. The corresponding portions of the conductor 24 are identified in FIG. 1 by the subscript "*a*".

As previously stated the coupler is physically small, approximately 0.7" between the ports C and D. This permits two amplifiers, for example, to be connected with the conductors 22 and 24 in very close proximity to provide a very small, high power unit. In space applications it is desirable to make the power unit as small as possible, and to make the line length as short as possible so that minimum energy is wasted. In order to accomplish this the conductors are bent at a 90 degrees angle forming an H pattern. Best performance is achieved with a 3 dB or 50% split between the input and output power. If a 50% split is achieved, return losses automatically drop to approximately 40 dB. While this is not possible to achieve in practice, a 20 dB drop in return loss is considered a good design. The present invention achieves better than a 26 dB drop in return loss i.e. the insertion loss is less than 0.05 dB.

The coupler is designed to have a 3 dB midband coupling at the output ports with a terminating impedance of 50 ohms. In order to make the coupler physically small the square cavity is only 0.250"×0.250". The dimensions of a 50 ohm conductor is then 0.100"×0.100". Since tuning stubs are not used, the conductors 22 and 24 may be symmetrically located with respect to the upper and lower ground planes as represented by the top 14 and bottom 16 of the housing 12. In the coupling or central portions of the conductors, where the conductor 22 overlaps the conductor 24, the thickness of each conductor is reduced by approximately 0.05". The gap between the central portions of the conductors 22 and 24 controls the coupling of the energy between the two conductors. The thickness, and width of the conductors 22 and 24 as well as the gap determine the loss and the coupling factors of the coupler 10.

Figure 5:
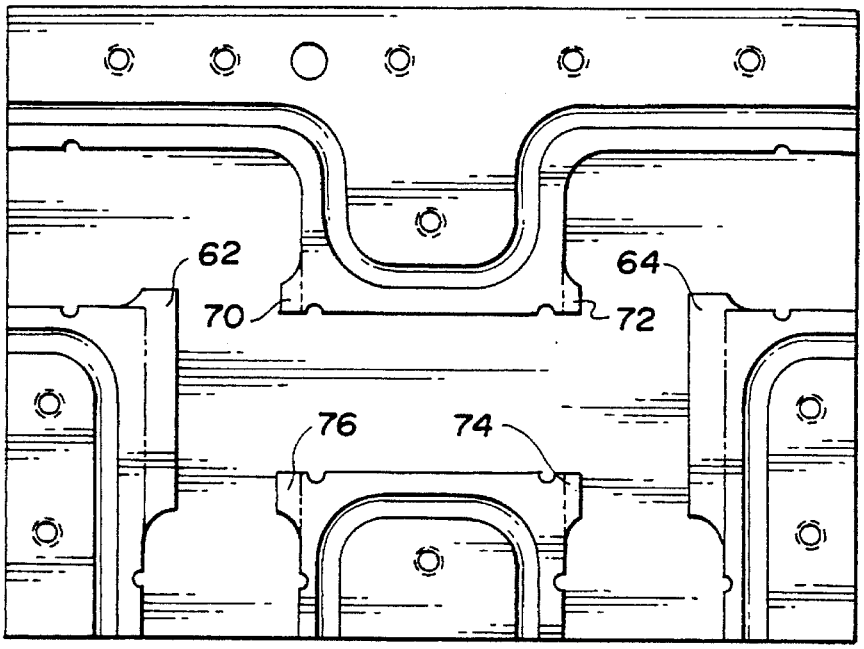
FIG. 5 is a top view similiar to FIG. 1 with the conductors removed.

The discontinuities introduced by right angle bend in the conductors 22 and 24, produce series inductance and fringing capacitances which must be compensated. In order to maintain a 50 ohm line throughout the length of the conductors 22 and 24, it is necessary that the inductance and capacitance be matched. In the present invention the matching is accomplished by machining the cavity wall so that it is closer to the conductors 22 and 24 in the area of the 90 degree bends to create an increase in capacitance to compensate for the inductance introduced by the bends. Thus the cavity wall portions 62 and 64 protrude inwardly toward the conductors by approximately the amount of the edges 66 and 68 respectively. The cavity wall portions 70–76 also protrude inwardly on the other side of the conductors 22 and 24. In each case the protruding wall portions extend inwardly by the amount indicated by the dotted line extensions of the cavity walls shown in FIG. 5. The additional material represented by the wall portions 62 and 64, added where the bend occur at the ends of the coupling region where the conductors 22 and 24 overlap, permits a substantially 3 dB split to be achieved. The additional material represented by the wall portions 70–76, perform the same function of compensating for the discontinuities introduced by the bends between the portions 52 and 54 of conductor 22 and the corresponding portions of the conductor 24.

Figure 6:
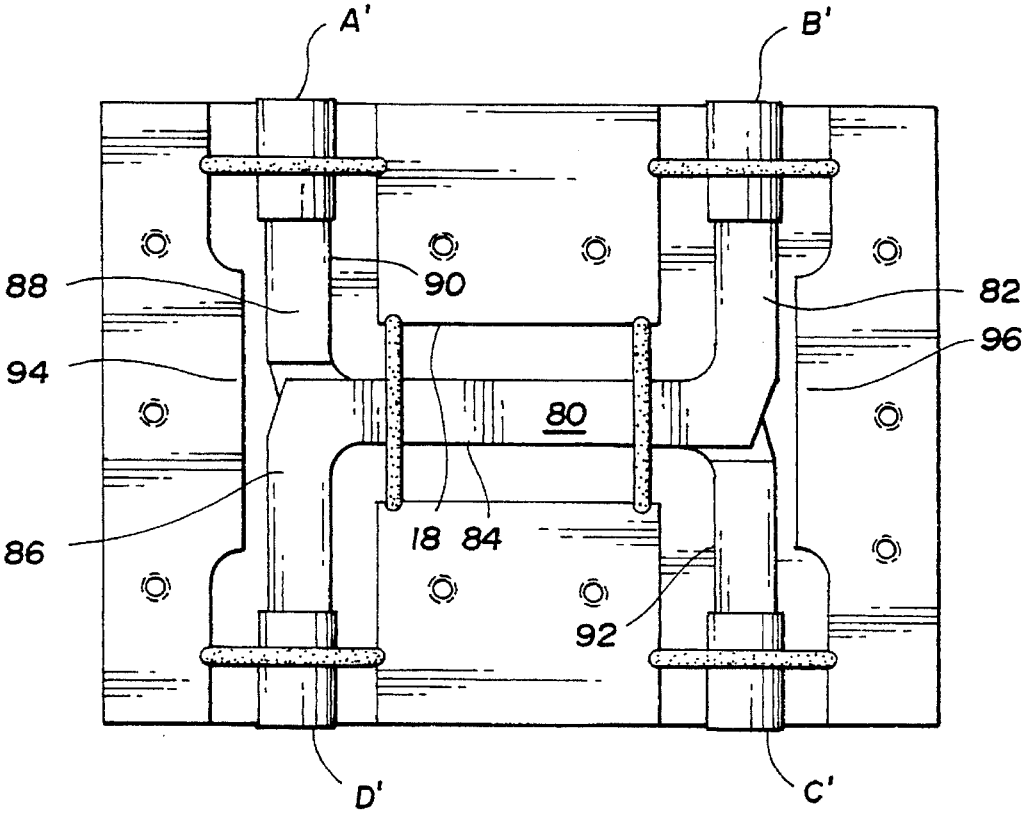
FIG. 6 is a top view of a second embodiment of the invention with the top portion of the coupler housing removed.

A 2-way splitter/combiner implementation, is shown in FIG. 6, where corresponding elements are indicated by prime numbers. As compared to the 2-way splitter/combiner of FIG. 1, the bends between the portions 52 and 54 of the conductor 22 and the portions 52*a* and 54*a* of the conductor 24 are not necessary. In this embodiment the conductor 80 has portion 82 extending upwardly at a right angle from a central portion 84 while a portion 86 extends downwardly from the central portion 84. The central portion 84 overlaps a central portion, not shown, of a second conductor 88, having an upwardly extending portion 90 and a downwardly extending portion 92, each at right angles with the central portion. In the area of the 90 degree bends, the cavity is machined so that the walls 94 and 96 are relatively close to the conductors 80 and 88, to create an increase in capacitance to compensate for the inductance introduced by the bends.

A 4-way splitter/combiner implementation is shown in FIG. 7. The 4-way coupler is generally designated 98 and includes a substantially square shaped cavity 100. The 4-way coupler 98 is an extension of the 2-way coupler of FIG. 1 and includes conductors 102–108 mounted in the cavity 100. The conductors 102 and 108 are substantially identical to the conductors 24 and 22, respectively, in FIG. 1. The cavity 100 is tuned as previously explained in connection with FIG. 1 in areas where bends occur in the conductors 102, 104, 106 and 108. In the interest of brevity, further description of the tuning is believed unnecessary. There are three central or overlapping conductor areas between pair of conductors 102,104; 104,106; and 106,108. Accordingly, there are three pairs of supports and spacers or six supports and six spacers in the overlapping areas. The supports are designated 110,112; 114,116; and 118,120 and are mounted within the cavity 100 as discussed in connection with FIG. 1. The spacers are not shown in FIG. 7 but are provided with each of the supports 110–120 in the manner shown in FIG. 2 with respect to the spacer 42. In addition to supports 122–136 provided at the terminating ends of the conductors 102–108, supports 138 and 140 are provided for supporting the conductors 104 and 106 intermediate the overlapping conductor areas. Terminating caps 142, 144 and 146 provide 50 ohm loads for three of the eight ports of the 4-way splitter/combiner. The remaining port designated M, N, O, P, and Q permit signals at four input ports (M,N,O,P) to be combined at a single output port Q, or one input signal at port Q to be split four ways at output ports M,N,O,P.

Figure 8:
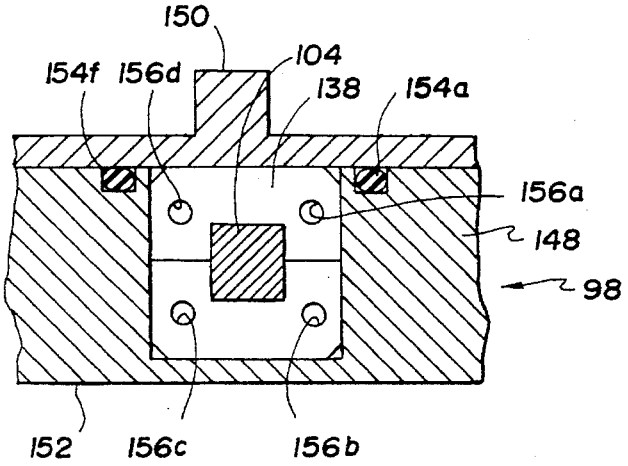
FIG. 8 is a is a cross sectional view taken along lines 8—8 of FIG. 7.

With reference now to FIG. 8, the coupler 98 further includes a housing 148 having a cover or top element 150 and a bottom element 152. The housing is machined from a block of aluminum and is grounded so that the top 150 and bottom 152 provide upper and lower ground planes respectively. Gaskets 154*a*–154*h*(FIG. 7) minimize radiation leakage from the cavity. Each of the supports 110–120, 138 and 140 include four openings, designated 156*a*–156*d* for the support 138 in FIG. 8. These openings perform the function of equalizing the pressure within the various chambers of the cavity, defined by the supports as well as minimizing the adverse tuning effects resulting from the dielectric supports by reducing the capacitance introduced by the supports.

Figure 9:
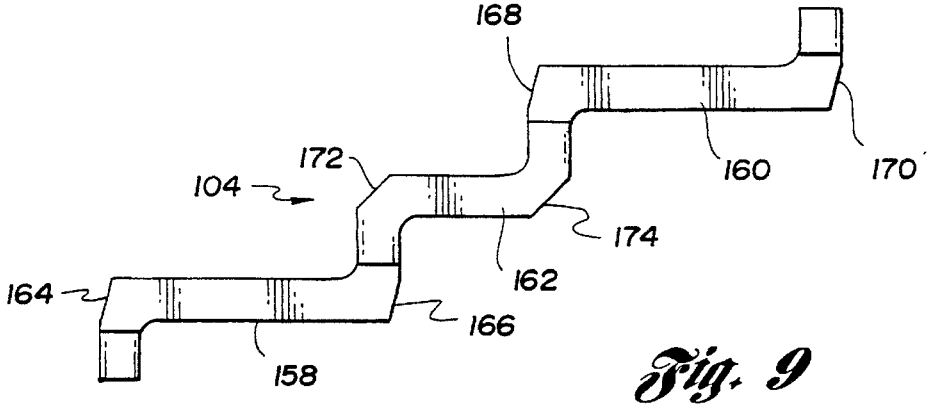
FIG. 9 is top view of one of the conductors shown in FIG. 7.

Referring now to FIG. 9, the conductor 104 is shown in greater detail with the terminals, shown in FIG. 7, removed. Conductor 106 is a mirror image of the conductor 104. The conductor 104 has a pair of end portion 158 and 160 of reduced thickness to accommodate the reduced thickness of the overlapping central portions of the conductors 102 and 106 respectively. The reduction in thickness of the portions 158 and 160 is substantially as represented by the reduced thickness central portion of the conductor 22 in FIG. 4. An integral, generally S- shaped portion 162, of square cross-section as shown in FIG. 8, interconnects the central portions 158 and 160. Opposite ends of the overlapping central portions 158 and 160, where the 90 degree bends occur, are chamfered at a 15 degree angle, as indicated at 164–170. This is done to fine tune the center frequency of the coupler. Where the 90 degree bends occur in the portion 162, the conductor 104 is chamfered at a 45 degree angle as indicated at 172 and 174.

While the forms of the invention herein disclosed are presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

What is claimed is:

1. A 3 dB hybrid coupler comprising a housing forming a cavity with upper and lower ground planes, first and second conductors supported within said cavity, each conductor having a central portion which is a multiple of a quarter-wave length and second and third portions extending from said central portion in opposite directions forming substantially 90 degree bends in said conductors, said central portion of each conductor overlapping the other for its entire length to form a generally H shaped configuration with a coupling region for coupling electromagnetic energy between the two conductors, said housing including an inner wall having capacitive tuning portions integrally formed therewith in the vicinity of the coupling region adjacent the conductor bends, said capacitive tuning portions cooperating with the first and second conductors to create an increase in capacitance to compensate for discontinuities introduced by said bends.

2. The invention defined in claim 1 wherein each conductor includes a fourth portion extending from said second portion forming an additional substantially 90 degree bend in each of said conductors, said housing includes additional integral tuning wall portions, located adjacent said additional bends to produce a 50 ohm line.

3. The invention defined in claim 2 wherein each of said central portions includes a chamfered corner to reduce overall length and thereby tune the cavity to a center frequency.

4. The invention defined in claim 3 further comprising input/output contact means connected with the terminating portions of each of said conductors, and a plurality of supports attached to the walls of the housing cavity and supporting each of said conductors within said housing cavity.

5. The invention defined in claim 4 further comprising at least two spacers for maintaining separation between the central portions of said conductors.

6. The invention defined in claim 5 wherein said plurality of supports include openings to permit equalization of pressure within said cavity.

7. The invention defined in claim 6 wherein said plurality of supports are formed of a dielectric and said openings minimize the capacitance introduced by said supports.

8. A 6 dB hybrid coupler comprising a housing forming a cavity with upper and lower ground planes, first, second, third and fourth conductors supported within said cavity, each of said first and second conductor having a central portion of reduced cross-sectional thickness which is a multiple of a quarter-wave length and second and third portions extending from said central portion in opposite directions forming substantially 90 degree bends in said conductors, each of said first and second conductor includes a fourth portion extending from said second portion forming an additional substantially 90 degree bend in each of said first and second conductors, each of said third and fourth conductors having a pair of end portions of reduced cross-sectional thickness each of which end portions are a multiple of a quarter-wave length and terminate in a substantially 90 degree bend, an integral generally S-shaped portion of substantially square cross-section terminating in substantially 90 degree bends which interconnect said end portions, said central portion of said first conductor overlapping an end portion of said third conductor to form a coupling region for coupling electromagnetic energy between said first and third conductors, said central portion of said second conductor overlapping an end portion of said fourth conductor to form a coupling region for coupling electromagnetic energy between said second and fourth conductors, the other end portions of said third and fourth conductors overlapping to form a coupling region for coupling electromagnetic energy between said third and fourth conductors, said housing including an inner wall having capacitive tuning portions integrally formed therewith in the vicinity of the coupling region adjacent the conductor bends to compensate for discontinuities introduced by said bends.

9. The invention defined in claim 8 wherein each of said overlapping portions of said first, second, third and fourth conductors includes a chamfered corner to reduce overall length and tune the cavity to a center frequency.

10. The invention defined in claim 9 further comprising a plurality of supports mounted in the walls of the housing cavity and supporting each of said conductors within said housing cavity.

11. The invention defined in claim 10 further comprising at least two supports supporting each of the overlapping portions of said conductors and at said least two spacers for maintaining separation between the overlapping portions of said conductors.

12. The invention defined in claim 11 wherein said plurality of supports include openings to permit equalization of pressure within said cavity.

13. The invention defined in claim 12 wherein said plurality of supports are formed of a dielectric and said openings minimize the capacitance introduced by said supports.

14. The invention defined in claim 13 further comprising input/output contact means connected with the terminating ends of each of said conductors, and one of said plurality of supports supporting each of said conductor terminating ends.

15. The invention defined in claim 14 wherein said coupler comprising eight ports, three of which are terminated by 50 ohm loads and the remaining five of which are input/output ports.

* * * * *